US007695826B2

(12) United States Patent
Tanaka et al.

(10) Patent No.: US 7,695,826 B2
(45) Date of Patent: Apr. 13, 2010

(54) ALLOYED MOLTEN ZINC PLATED STEEL SHEET AND PROCESS OF PRODUCTION OF SAME

(75) Inventors: Koki Tanaka, Futtsu (JP); Yoichi Ikematsu, Futtsu (JP); Shunichi Hayashi, Futtsu (JP); Hideaki Sawada, Futtsu (JP); Akira Takahashi, Kimitsu (JP); Kazuhiko Honda, Kimitsu (JP); Masayoshi Suehiro, Futtsu (JP); Yoshihisa Takada, Kitakyushu (JP)

(73) Assignees: Nippon Steel Corporation, Tokyo (JP); USINOR, Puteaux (FR)

( * ) Notice: Subject to any disclaimer, the term of this patent is extended or adjusted under 35 U.S.C. 154(b) by 174 days.

(21) Appl. No.: 10/551,159

(22) PCT Filed: Mar. 30, 2004

(86) PCT No.: PCT/JP2004/004533

§ 371 (c)(1),
(2), (4) Date: Sep. 28, 2005

(87) PCT Pub. No.: WO2004/087983

PCT Pub. Date: Oct. 14, 2004

(65) Prior Publication Data

US 2006/0269776 A1 Nov. 30, 2006

(30) Foreign Application Priority Data

Mar. 31, 2003 (JP) ..... 2003-094728

(51) Int. Cl.
*B32B 15/18* (2006.01)
*C23C 2/28* (2006.01)
*C23C 2/06* (2006.01)

(52) U.S. Cl. ..... 428/659; 148/533; 427/433

(58) Field of Classification Search ..... 428/615, 428/632, 633, 658, 659, 681, 684, 687, 332
See application file for complete search history.

(56) References Cited

U.S. PATENT DOCUMENTS 7,294,412 B2 * 11/2007 Takada et al. ..... 428/659

(Continued)

FOREIGN PATENT DOCUMENTS

EP 1 076 105 A1 2/2001

(Continued)

OTHER PUBLICATIONS

English machine translation of JP 2001-323355. Nov. 2001.*

(Continued)

*Primary Examiner*—John J Zimmerman
(74) *Attorney, Agent, or Firm*—Kenyon & Kenyon LLP

(57) ABSTRACT

The present invention provides an alloyed molten zinc plated steel sheet having an area of the Fe and Zn alloy phase in the unformed parts in the plating layer of less than 10% of the area of the steel sheet as a whole and superior in strength and shapeability and a method of producing this alloyed molten zinc plating steel sheet by a continuous zinc plating production system which enables production at a low cost without modification of the system or addition of steps, said alloyed molten zinc plated steel sheet characterized by comprising a steel sheet including C: 0.05 to 0.40%, Si: 0.2 to 3.0%, and Mn: 0.1 to 2.5%, the balance comprised of Fe and unavoidable impurities, having on its surface a Zn alloy plating layer comprised of Fe in a concentration of 7 to 15 wt %, Al in a concentration of 0.01 to 1 wt %, and the balance of Zn and unavoidable impurities, said plating layer containing oxide particles of at least one type of oxide selected from an Al oxide, Si oxide, Mn oxide, and complex oxides of the same alone or in combination.

6 Claims, 1 Drawing Sheet

FOREIGN PATENT DOCUMENTS

| | | | |
|---|---|---|---|
| EP | 1 149 928 | A1 | 10/2001 |
| JP | 55-122865 | | 9/1980 |
| JP | 5-59429 | | 3/1993 |
| JP | 8-291367 | | 11/1996 |
| JP | 08-291367 | * | 11/1996 |
| JP | 2000-290730 | * | 10/2000 |
| JP | 2000-309824 | | 11/2000 |
| JP | 2001-200352 | | 7/2001 |
| JP | 2001-279412 | | 10/2001 |
| JP | 2001-288550 | | 10/2001 |
| JP | 2001-323355 | | 11/2001 |
| JP | 2003-055751 | * | 2/2003 |
| JP | 2003-55751 | | 2/2003 |
| JP | 2004-204280 | | 7/2004 |
| WO | WO 01/77400 | | 10/2001 |

U.S. PATENT DOCUMENTS

| | | | | |
|---|---|---|---|---|
| 2001/0031377 | A1 | 10/2001 | Hashimoto et al. | |
| 2002/0160221 | A1 | 10/2002 | Takeda et al. | |
| 2003/0054195 | A1 | 3/2003 | Ishii et al. | |
| 2004/0202889 | A1 * | 10/2004 | Fujita et al. | 428/659 |
| 2006/0124907 | A1 * | 6/2006 | Takada et al. | 252/500 |

OTHER PUBLICATIONS

Supplementary European Search Report of European Patent Application No. EP 04 72 4397 mailed Nov. 22, 2007.

Chinese Office Action dated Jun. 27, 2008 issued in corresponding Chinese Application No. 2004800090110.

* cited by examiner

ALLOYED MOLTEN ZINC PLATED STEEL SHEET AND PROCESS OF PRODUCTION OF SAME

TECHNICAL FIELD

The present invention relates to a high strength, alloyed molten zinc plated steel sheet able to be utilized as a member of an automobile, building material, or electrical appliance and a process of production of the same.

BACKGROUND ART

In the auto industry, demand has been rising for steel sheet provided with the properties of both shapeability and high strength so as to achieve both lighter weight of the chassis to deal with environmental problems and safety in collisions.

To deal with these needs, Japanese Unexamined Patent Publication (Kokai) No. 5-59429 discloses steel sheet having as the steel sheet structure a mixture of the three phases of the ferrite phase, bainite phase, and austenite phase and transforming the residual austenite to martensite at the time of shaping so as to utilize the transformation-induced plasticity exhibiting a high ductility. This type of steel sheet for example forms a complex structure by the addition, by wt %, of C: 0.05 to 0.4%, Si: 0.2 to 3.0% A, and Mn: 0.1 to 2.5% in the steel and controlling the temperature pattern in the process of annealing in the two-phase region, then cooling and is characterized in that the desired properties can be brought out without the use of expensive alloy elements.

When zinc plating this steel sheet by a continuous molten zinc plating system, usually the surface of the steel sheet is degreased, the surface is cleaned, then, for the purpose of forming the above-mentioned structure, the sheet is heated in an nonoxidizing furnace to form an iron oxide layer of a thickness of 50 nm to 1 μm or so on the surface of the steel sheet, annealing the sheet in a reducing furnace to reduce the iron oxide layer, then dipping the sheet in a molten zinc plating bath to plate it with zinc. When producing an alloyed molten zinc plated steel sheet, the steel sheet is dipped in a plating bath in that step, then held at a temperature of 400 to 600° C. or so to alloy the zinc and iron and convert the plating layer to an alloy phase of Fe and Zn constituting an δ1 phase.

Steel sheet, however, contains large amounts of easily oxidizing elements such as Si and Mn compared with the ordinary deep drawn cold-rolled steel sheet etc., so there is the problem that the surface of the steel sheet is easily formed with Si oxides, Mn oxides, or Si and Mn complex oxides in the heat treatment performed in the above series of steps. However, in industrial scale systems, it is difficult to reduce the oxygen potential of the atmosphere in the heating step to an extent where Si or Mn will not be oxidized, so formation of Si and Mn oxides at the surface of the steel sheet is substantially unavoidable. Further, if the surface of the steel sheet is formed with an Si oxide layer or Mn oxide layer, there is the problem that the alloying of the Zn and Fe is inhibited in the alloying step at the time of production of the alloyed molten zinc plated steel sheet and parts where the Fe—Zn alloy phase have not yet been formed remain.

One method easily conceivable as a means for solving these problems is to set the alloying treatment temperature slightly high to promote alloying of Fe and Zn. At the alloying treatment temperature of 450 to 600° C., however, austenitic transformation occurs in the steel sheet, so if setting the alloying treatment temperature slightly high, depending on the holding time, the structure of the steel sheet will not become the desired mixed structure of a mixture of the three phases of the ferrite phase, bainite phase, and austenite phase. As a result, there is the problem that the shapeability and strength of the steel sheet aimed at cannot be secured in some cases.

To deal with this problem, Japanese Unexamined Patent Publication (Kokai) No. 55-122865 discloses the method of forming a 40 to 1000 nm iron oxide layer on the surface of a steel sheet in a heat treatment step by a nonoxidizing furnace in a continuous molten zinc plating step so as to prevent outward diffusion of the Si or Mn in the reduction step, suppress the formation of the Si oxide layer, and improve the plating properties. With this method, however, if the reduction time is too long for the thickness of the iron oxide layer, Si will become dense at the surface of the steel sheet and an Si oxide layer will be formed, while if the reduction time is too short, iron oxide will remain on the surface of the steel sheet and defects in the plating properties, that is, the formation of unformed parts of the Fe—Zn alloy phase will be formed. Further, in recent continuous molten zinc plating systems, annealing systems using radiant type heating furnaces rather than nonoxidizing furnaces are becoming the mainstream. In such systems, there was the problem that the above method could not be used.

Further, Japanese Unexamined Patent Publication (Kokai) No. 2000-309824 discloses as a method for preventing selective oxidation of the Si or Mn at the time of annealing the method of hot rolling the steel sheet, then heat treating it in the state with the black skin scale still attached in an atmosphere where reduction will substantially not occur and in a temperature range of 650 to 950° C. so as to form a sufficient internal oxide layer in the base iron surface layer. With this method, however, in addition to the conventional continuous molten zinc plating step, a heat treatment step for forming the internal oxide layer and a pickling treatment step become necessary, so there was the problem that a rise in production costs was invited. Further, the plated steel sheet having the internal oxide layer had the problem of easily peeling of the plating layer.

DISCLOSURE OF INVENTION

In view of the above problems, the present invention has as its object the provision of an alloyed molten zinc plated steel sheet wherein the area of the unformed parts of the Fe—Zn alloy phase in the plating layer is less than 10% of the area of the steel sheet as a whole and wherein the strength and shapeability are superior. Further, it has as its object the provision of a process of production of the alloyed molten zinc plated steel sheet at a low cost without modifying the system or adding steps in a conventional continuous molten zinc plating production system.

To solve the above problem, the inventors engaged in intensive studies and as a result newly discovered that by including in the plating layer oxide particles of at least one type selected from an Al oxide, Si oxide, Mn oxide, Al and Si complex oxide, Al and Mn complex oxide, Si and Mn complex oxide, and Al, Si, and Mn complex oxide alone or in combination, alloying of the plating layer is promoted and uniform alloying across the entire surface of the steel sheet is obtained and made it possible to provide an alloyed molten zinc plating steel sheet wherein the area of the unformed parts of the Fe—Zn alloy phase in the plating layer is less than 10% of the area of the steel sheet as a whole and wherein the strength and shapeability are superior.

The fundamental reason why addition of oxide particles in the plating layer causes alloying of the plating layer to be promoted and a uniform alloy layer to be obtained across the entire steel sheet is unclear, but the inventors continued with their intensive studies and as a result discovered that by making the plating layer the above structure, the alloying of Fe—Zn occurs uniformly across the entire surface of the steel sheet.

Further, the inventors discovered that the above alloyed molten zinc plated steel sheet can be obtained by adjusting the ratio $PH_2O/PH_2$ of the steam partial pressure and hydrogen partial pressure of the atmosphere in the reducing furnace in the recrystallization annealing step of a continuous molten zinc plating system to $1.4\times10^{-10}T^2-1.0\times10^{-7}T+5.0\times10^{-4}$ to $6.4\times10^{-7}T^2+1.7\times10^{-4}T-0.1$ with respect to the heating temperature T (° C.), forming internal oxide at a region from the surface of the steel sheet to a depth of 1.0 μm, then successively performing molten zinc plating treatment and alloying treatment. The present invention has the following as its gist:

(1) An alloyed molten zinc plated steel sheet characterized by comprising a steel sheet including, by wt %, C: 0.05 to 0.40%,
Si: 0.2 to 3.0%, and
Mn: 0.1 to 2.5% and
further including at least one or two or more types of:
P: 0.001 to 0.05%,
S: 0.001 to 0.05%,
Al: 0.01% to 2%,
B: 0.0005% to less than 0.01%,
Ti: 0.01% to less than 0.1%,
V: 0.01% to less than 0.3%,
Cr: 0.01% to less than 1%,
Nb: 0.01% to less than 0.1%,
Ni: 0.01% to less than 2.0%,
Cu: 0.01% to less than 2.0%,
Co: 0.01% to less than 2.0%,
Mo: 0.01% to less than 2.0%,
with the balance comprised of Fe and unavoidable impurities, having on its surface a Zn alloy plating layer comprised of Fe in a concentration of 7 to 15 wt %, Al in a concentration of 0.01 to 1 wt %, and the balance of Zn and unavoidable impurities, said plating layer containing oxide particles of at least one type of oxide selected from an Al oxide, Si oxide, Mn oxide, Al and Si complex oxide, Al and Mn complex oxide, Si and Mn complex oxide, and Al, Si, and Mn complex oxide alone or in combination.

(2) An alloyed molten zinc plated steel sheet as set forth in (1), characterized in that said oxide particles are comprised of at least one of silicon oxide, manganese oxide, aluminum oxide, aluminum silicate, manganese silicate, manganese aluminum oxide, and manganese aluminum silicate.

(3) An alloyed molten zinc plated steel sheet as set forth in (1), characterized in that an average diameter of the particle size of said oxide is 0.01 to 1 μm.

(4) An alloyed molten zinc plated steel sheet as set forth in any one of (1) to (3), characterized in that the structure of said steel sheet has a complex structure of a ferrite phase, bainite phase, and residual austenite phase.

(5) A process of production of an alloyed molten zinc plated steel sheet comprised of the ingredients described in (1) by a continuous molten zinc plating system, said process of production of an alloyed molten zinc plated steel sheet characterized by making a heating temperature T at a recrystallization annealing step in a reducing furnace of said system 650° C. to 900° C., passing the steel sheet through an atmosphere where a ratio $PH_2O/PH_2$ of the steam partial pressure $PH_2O$ and hydrogen partial pressure $PH_2$ of the atmosphere of said reducing furnace is $1.4\times10^{-10}T^2-1.0\times10^{-7}T+5.0\times10^{-4}$ to $6.4\times10^{-7}T^2+1.7\times10^{-4}T-0.1$, forming internal oxide at a region from the surface of the steel sheet to a depth of 1.0 μm, then successively performing molten zinc plating treatment and alloying treatment.

(6) A process of production of an alloyed molten zinc plated steel sheet as set forth in (5), characterized in that said oxide particles are comprised of at least one of silicon oxide, manganese oxide, aluminum oxide, aluminum silicate, manganese silicate, manganese aluminum oxide, and manganese aluminum silicate.

(7) A process of production of an alloyed molten zinc plated steel sheet as set forth in (5), characterized in that an average diameter of the particle size of said oxide is 0.01 to 1 μm.

(8) A process of production of an alloyed molten zinc plated steel sheet as set forth in any one of (5) to (7), characterized in that the structure of said steel sheet has a complex structure of a ferrite phase, bainite phase, and residual austenite phase.

BEST MODE FOR CARRYING OUT THE INVENTION

Figure 1:
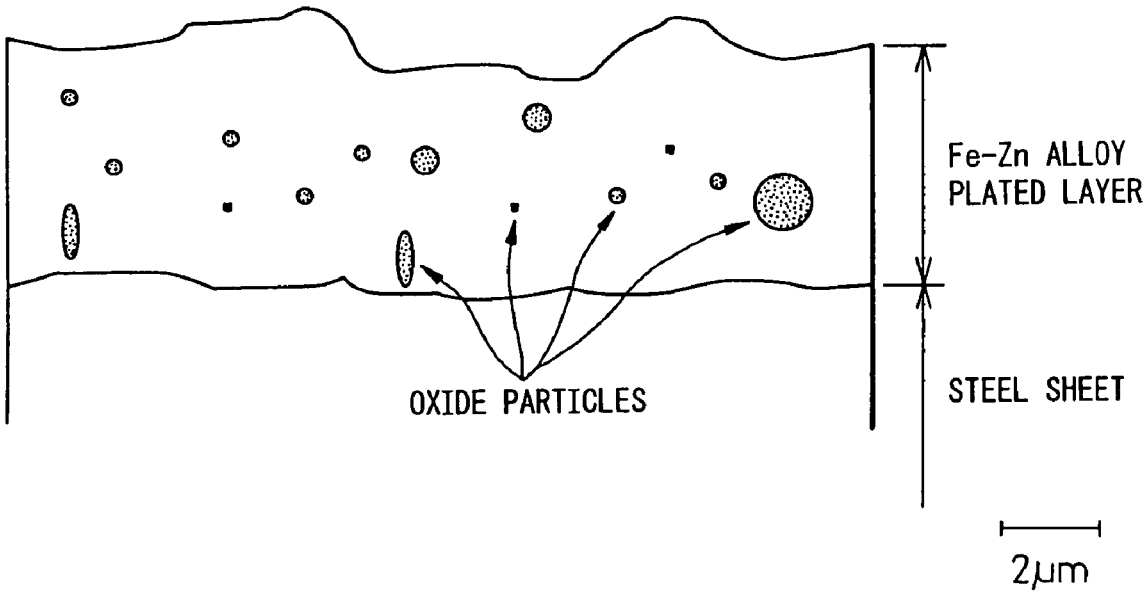
FIG. 1 is a schematic view of an example of the cross-section of an alloyed molten zinc plated steel sheet of the present invention.

The alloyed molten zinc plated steel sheet of the present invention is characterized by being provided with both a superior press formability and strength and by having an area occupied by the parts where the Fe—Zn alloy phase is not formed in the plating layer of less than 10% of the area of the steel sheet as a whole.

To impart this characterizing feature, first, to secure the ductility and strength of the steel sheet itself, the ingredients of the steel sheet are made, by wt %, C: 0.05 to 0.40%, Si: 0.2 to 3.0%, Mn: 0.1 to 2.5%, and the balance of Fe and unavoidable impurities, while the structure of the steel sheet is made a complex phase structure including the ferrite phase, bainite phase, and austenite phase. Note that the contents of the steel composition defined in the present invention are all wt %.

The reasons for addition of the additive elements to the steel sheet base material of the alloyed molten zinc plated steel sheet used in the present invention will be explained below.

C is an element added for stabilizing the austenite phase of the steel sheet. If the content of the C is less than 0.05%, its effect cannot be expected. Further, if over 0.40%, the bondability is degraded and a detrimental effect is given when actually using the molten zinc plated steel sheet of the present invention, so the content is made 0.05% to 0.4%.

Si is an element required when creating a stable presence of an austenite phase even at room temperature due to the action of increasing the concentration of C in the austenite phase. If the content is less than 0.2%, its effect cannot be expected, while if over 3.0%, the internal oxide film is formed thickly—inviting peeling of the plating, so the content of Si is made 0.2% to 3.0%.

Mn is an element required for preventing the austenite from transforming to pearlite in the heat treatment step. If the content is less than 0.1%, its effect is nonexistent, while if over 2.5%, the bonded parts break and there are other detrimental effects in actual use of the molten zinc plated steel sheet of the present invention, so the concentration of the Mn is made 0.1% to 2.5%.

The steel sheet base material of the present invention basically contains the above elements, but the added elements are not limited to just these elements. It is also possible to include elements already known to have the effect of improvement of the properties of the steel sheet, for example, Al having the effect of improving the press formability. The amount of Al required for improving the press formability of steel sheet is preferably at least 0.01%. Excessive addition of Al would invite degradation of the plating properties and an increase in inclusions, so the content of Al is preferably not more than 2%.

Further, it is possible to add P:0.001 to 0.05% and S:0.001 to 0.05%. P is an element required for strengthening the steel in an amount in accordance with the required strength. If the excess amount of P is added, P segregates at grain boundaries and deteriorates elongation. Therefore, the upper limit of the P addition is preferable limited to 0.05%. On the other hand, the lower limit of the P addition is preferable limited to 0.001% because of considering the increase of the refining cost in the steel making process.

S is an unfavorable element for deteriorating local elongation and weldability of the steel because of forming MnS. Therefore, the upper limit of the S addition is preferable limited to 0.05%. On the other hand, the lower limit of the S addition is preferable limited to 0.001% because of considering the increase of the refining cost in the steel making process as the same reason as P.

Further, for example, it is also possible to add one or two or more of B, Ti, V, Cr, and Nb having the effect of improvement of quenching in an amount of B of 0.0005% to less than 0.01%, Ti of 0.01% to less than 0.1%, V of 0.01% to less than 0.3%, Cr of 0.01% to less than 1%, and Nb of 0.01% to less than 0.1%. These elements are added with the expectation of improving the quenchability of the steel sheet, so if less than the above contents, no effect of improvement of the quenchability can be expected. Further, inclusion in an amount over the upper limit of the above content is possible, but the effect becomes saturated and an effect of improvement of quenchability commensurate with the cost can no longer be expected.

Further, for example, it is also possible to include Ni, Cu, Co, Mo, and other elements having the effect of improvement of strength in amounts of 0.01% to less than 2.0%. These elements are added in the expectation of the effect of improvement of strength. On the other hand, an excessive content of Ni, Cu, Co, or Mo leads to excessive strength or a rise in the alloy costs. Further, the sheet may also contain N and other generally unavoidable elements.

The molten zinc plated steel sheet of the present invention is made a complex phase structure comprised of the three phases of a ferrite phase, austenite phase, and bainite phase in order to impart superior processability and strength by processing-induced transformation at room temperature.

The composition of the plating layer of the alloyed molten zinc plated steel sheet according to the present invention is made, by wt %, a concentration of Fe of 7 to 15%, a concentration of Al of 0.01 to 1%, and a balance of Zn and unavoidable impurities.

The reason is that, for Fe, if the concentration of Fe of the plating layer is less than 7%, chemical conversion treatment becomes poor, while if over 15%, peeling of the plating occurs due to the processing. For Al, if the content of Al in the plating layer is less than 0.01%, the alloying of Fe and Zn becomes excessive, while if over 1%, the corrosion resistance is degraded. Further, the basis weight of the plating is not particularly limited.

Next, the structure of a plating layer of the alloyed molten zinc plated steel sheet of the present invention will be explained.

FIG. 1 shows an example of a schematic view of the cross-section of an alloyed molten zinc plated steel sheet of the present invention. The alloyed molten zinc plated steel sheet of the present invention is of a structure containing at least one of particles of Al oxide, Si oxide, Mn oxide, Al and Si complex oxide, Al and Mn complex oxide, Si and Mn complex oxide, and Al, Si, and Mn complex oxide contained in the plating layer alone or in combination. By making the plating layer such a structure, alloying of the Fe and Zn is promoted by the oxide particles in the plating layer, uniform alloying occurs across the entire surface of the steel sheet, and the parts where the Fe—Zn alloy phase is not formed become less than 10% of the area of the steel sheet as a whole.

The extent of alloying of Fe—Zn of the plating layer is evaluated by randomly selecting analysis points from a steel sheet, assaying the ingredients of the plating layer, and judging cases where the composition of the plating layer is in the range of the present invention, that is, where the concentration of Fe is in the range of 7 to 15 wt %, as passing. The analysis method is not particularly limited. The following examples of the analysis method and evaluation do not limit the present patent either. As the analysis method, for example, it is possible to use the method of assaying the concentration of Fe in the plating layer by glow discharge optical emission spectrometry, fluorescent X-ray analysis, X-ray microanalysis, or transmission electron microscope or of chemically analyzing the plating layer by dissolving it in a solution. The size of each analysis point should be set to the optimal size in accordance with the analysis method used. Further, the number of analysis points per steel sheet is also not limited, but to obtain very representative evaluation results, a plurality of locations are analyzed for one steel sheet and it is confirmed that the locations where the composition of the plating layer is in the range of the present invention, that is, where the concentration of Fe is in the range of 7 to 15 wt %, account for at least 90% of the total analyzed locations. For this purpose, as the number of analysis points, it is desirable to analyze at least five locations randomly selected for a steel sheet.

For example, it is possible to use the following method of evaluation. That is, the extent of alloying of Fe—Zn of the plating layer is evaluated by randomly selecting 10 analysis points from a steel sheet and assaying the concentration of Fe in the plating layer by glow discharge optical emission spectrometry. At this time, the size of each analysis point is made a constant diameter of 5 mm. Cases where at least nine locations having concentrations of Fe in the plating layer of 7 to 15 wt % are judged as passing and other cases are judged as failing. Cases where there are two or more locations where the concentration of Fe in the plating layer is less than 7 wt % are judged as being insufficiently alloyed and as therefore failing, while cases where there are two or more locations where the concentration is over 15 wt % are judged as being excessively alloyed.

The Al oxide, Si oxide, Mn oxide, Al and Si complex oxide, Al and Mn complex oxide, Si and Mn complex oxide, and Al, Si, and Mn complex oxide contained in the plating layer are respectively silicon oxide, manganese oxide, aluminum oxide, aluminum silicate, manganese silicate, manganese aluminum oxide, and manganese aluminum silicate. Si, Mn, and Al are elements added as ingredients of the steel sheet. These become oxides at the surface layer of the steel sheet in the heat treatment step of the steel sheet. They can be easily included in the plating layer for forming silicon oxide, manganese oxide, aluminum oxide, aluminum silicate, manganese silicate, manganese aluminum oxide, and manganese aluminum silicate. The method for including the oxide particles in the plating layer will be explained later.

Note that the oxide particles to be contained in the plating layer to promote the alloying of Fe and Zn of the plating layer may also be oxides other than the above silicon oxide, manganese oxide, aluminum oxide, aluminum silicate, manganese silicate, manganese aluminum oxide, and manganese aluminum silicate, but in this case the oxide particles have to be added to the plating bath or the main ingredient elements of the oxides have to be added to the steel sheet—inviting a rise of the production costs.

The size of the oxide particles contained in the plating layer is preferably an average diameter of 0.01 μm to 1 μm. The reason is that if the average diameter of the oxide particles is less than 0.01 μm, the effect of causing uniform alloying of Fe—Zn in the plating layer falls. If making the average diameter of the oxide particles more than 1 μm, at the time of processing the alloyed molten zinc plated steel sheet, the oxide particles easily become starting points of fracture and the corrosion resistance of the processed parts is degraded, that is, detrimental effects easily occur when putting the molten zinc plated steel sheet into practical use.

Note that the "average diameter" of the oxide particles referred to in the present invention indicates the average equivalent circular diameter of the oxide particles detected by observation of the cross section of the plating layer. The shape of the oxide particles may be spherical, plate-like, or conical.

As the method of measuring the average diameter of the oxide particles, the method may be mentioned of polishing the cross section of the alloyed molten zinc plated steel sheet or using FIB (focused ion beam processing system) to process the sheet to expose the cross section and thereby prepare a sample, then analyzing it by observation by a scan electron microscope, plane analysis by X-ray microanalysis, or plane analysis by Auger electron spectroscopy. Further, it is possible to process the cross section of the steel sheet to a thin piece so as to include the plating layer, then observe this by a transmission type electron microscope. In the present invention, the image data obtained by these analysis methods is analyzed to calculate the equivalent circular diameter of the oxide particles. The average value should be 0.01 μm to 1 μm. Particles of less than 0.01 μm and particles of more than 1 μm may also be included in the observed region.

Further, the content of the oxide particles in the plating layer is not particularly limited, but preferably the plating layer contains the particles in a density of $1\times10^{8}$ particles/cm$^2$ to $1\times10^{11}$ particles/cm$^2$. If the content of the oxide particles is less than $1\times10^{8}$ particles/cm$^2$, sometimes the effect of the alloying of the Fe and Zn of the plating layer being promoted and the uniform alloying occurring across the entire surface of the steel sheet cannot be expected. On the other hand, excess oxide particles of over $1\times10^{11}$ particles/cm$^2$ become a cause of peeling of the plating layer.

Next, the process of production of the alloyed molten zinc plated steel sheet of the present invention will be explained.

In the present invention, a continuous molten zinc plating system is used for alloyed molten zinc plating of the above high strength steel sheet.

In the process of production of an alloyed molten zinc plated steel sheet of the present invention, the heating pattern is set so that the steel sheet becomes the above desired structure in the recrystallization annealing step of the continuous molten zinc plating system. That is, a reducing furnace is used to anneal steel sheet in a two-phase coexisting region of 650 to 900° C. for 30 seconds to 10 minutes. The atmosphere in the reducing furnace is made a nitrogen gas including hydrogen gas in a range of 1 to 70 wt %. The inside of the furnace is adjusted to a ratio ($PH_2O/PH_2$) of the steam partial pressure and hydrogen partial pressure of the atmosphere by introducing steam. In the present invention, the ratio $PH_2O/PH_2$ of the steam partial pressure and hydrogen partial pressure of the atmosphere of the reducing furnace is adjusted to $1.4\times10^{-10}T^2-1.0\times10^{-7}T+5.0\times10^{-4}$ to $6.4\times10^{-7}T^2+1.7\times10^{-4}T-0.1$ with respect to the heating temperature T (° C.) in the recrystallization annealing step.

The reason for limiting the ratio $PH_2O/PH_2$ of the steam partial pressure and hydrogen partial pressure of the atmosphere of the reducing furnace to the above range is as follows. That is, in the present invention, since the steel sheet contains Si in an amount of at least 0.2 wt % and Mn in at least 0.1 wt %, if $PH_2O/PH_2$ is less than $1.4\times10^{-10}T^2-1.0\times10^{-7}T+5.0\times10^{-4}$, an external oxide film is formed on the surface of the steel sheet and poor bonding of the plating occurs. Further, in the present invention, the Si added to the steel sheet is not more than 3.0 wt % and Mn not more than 2.5 wt %, so if $PH_2O/PH_2$ exceeds $6.4\times10^{-7}T^2+1.7\times10^{-4}T-0.1$, fayalite and other Fe oxides are formed and plating gaps arise. By annealing by the above method, it is possible to form a region from the surface of the steel sheet to a depth of 1.0 μm with a structure having least one type of internal oxide of silicon oxide, manganese oxide, aluminum oxide, aluminum silicate, manganese silicate, manganese aluminum oxide, and manganese aluminum silicate alone or in combination.

Next, in the plating step, the steel sheet is cooled at a cooling rate of 2 to 200° C. per second to a temperature range of 250 to 500° C., held there for 5 seconds to 20 minutes, then plated by being dipped in a molten zinc plating bath comprised of Al in an amount of 0.01 wt % to 1 wt % with the balance of Zn and unavoidable impurities. The temperature and dipping time of the plating bath at this time are not particularly limited. Further, the example of the heating and cooling patterns in the plating step does not limit the present invention.

After the above molten zinc plating, in the alloying step, the steel sheet is held at a temperature of 450 to 600° C. for 5 seconds to 2 minutes to cause an alloying reaction of Fe and Zn and to cause the internal oxide formed at the surface of the steel sheet at the annealing step in the reducing furnace to migrate to the plating layer to form the characteristic of the alloyed molten zinc plated steel sheet of the present invention, that is, the plating layer structure containing oxide particles in a plating layer.

In the case of forming the above mentioned plating layer structure, all oxide particles formed at the surface of the steel sheet do not always move into the plating layer, but some of the oxide particles may remain in the steel sheet.

In the present invention, Fe and Zn alloying is promoted by the action of the oxide particles contained in the plating layer. If the heating temperature and holding time are in the above range in the alloying step, sufficiently uniform alloying is possible. Therefore, it is possible to finish the alloying treatment while the austenite phase in the steel sheets is not reduced. Consequently, steel sheets having the desired mixed structures of the ferrite phase, bainite phase, and austenite phase can be obtained.

EXAMPLES

Below, the present invention will be explained in detail by examples, but the present invention is not limited to these examples.

The test steel sheets shown in Table 1 were treated for recrystallization annealing, plating, and alloying by a continuous molten zinc plating system in accordance with the conditions shown in Table 2.

TABLE 1

| Test material | Composition (wt %) | | | | | | | | | | |
|---|---|---|---|---|---|---|---|---|---|---|---|
| code | C | Si | Mn | Al | P | S | Ti | Nb | Ni | Cu | Remarks |
| NA | 0.1 | 1.2 | 1.3 | | 0.004 | 0.003 | | | | | Invention |
| A | 0.1 | 0.2 | 1.6 | 0.1 | 0.005 | 0.006 | 0.02 | | 0.6 | 0.2 | Invention |
| B | 0.1 | 0.2 | 1.5 | 0.7 | 0.005 | 0.007 | 0.02 | 0.01 | 0.01 | 0.2 | Invention |
| C | 0.1 | 1.5 | 1.5 | 0.03 | 0.005 | 0.006 | | | 0.002 | | Invention |
| D | 0.05 | 1.4 | 2.3 | 0.3 | 0.005 | 0.007 | | | | | Invention |
| E | 0.1 | 1.5 | 0.5 | 0.2 | 0.004 | 0.006 | | | | | Invention |
| F | 0.1 | 0.1 | 1.4 | 0.4 | 0.006 | 0.003 | | | | | Comp. ex. |

TABLE 2

| Processing condition no. | Annealing temp. (° C.) | $PH_2O/PH_2$ | Remarks |
|---|---|---|---|
| 1 | 700 | 0.01 | Invention ex. |
| 2 | 700 | 0.0004 | Comp. ex. |
| 3 | 800 | 0.01 | Invention ex. |
| 4 | 800 | 0.03 | Invention ex. |
| 5 | 800 | 0.0004 | Comp. ex. |
| 6 | 800 | 0.0003 | Comp. ex. |
| 7 | 900 | 0.02 | Invention ex. |
| 8 | 900 | 0.0004 | Comp. ex. |

The molten zinc plating bath was adjusted to a bath temperature of 500° C. and a bath composition of Al of 0.1 wt % and the balance of Zn and unavoidable impurities. The atmosphere of the reducing furnace was adjusted to a ratio of the steam partial pressure and hydrogen partial pressure ($PH_2O/PH_2$) by introducing steam into $N_2$ gas to which $H_2$ gas is added in an amount of 10 wt % to adjust the amount of introduction of steam. The annealing temperature and $PH_2O/PH_2$ were set to the values shown in Table 2, each of the steel sheets shown in Table 1 was recrystallization annealed, then was dipped in the plating bath. The amount of plating was adjusted to 60 g/m$^2$ by nitrogen gas wiping. The alloying treatment was performed by heating the steel sheet in $N_2$ gas at 500° C. and holding it for 30 sec.

The strength of the steel sheets was evaluated by JIS Z 2201. 490 MPa or more was judged as passing. The elongation of the steel sheets was evaluated by obtaining a JIS 5 tensile test piece and performing an ordinary temperature tensile test at a gauge thickness of 50 mm and a tensile rate of 10 mm/min. A sheet exhibiting an elongation of 30% or more was judged as passing.

The oxide particles in the plating layer were evaluated by polishing the cross section of the plating layer to expose it and observing it and capturing an image of the oxide particles by a scan electron microscope (SEM). The image captured by the SEM was digitalized and the parts with a brightness corresponding to the oxides were extracted by image analysis to prepare a digital image. The prepared digital image was cleared of noise, then the equivalent circular diameters of the particles were measured and the average value of the equivalent circular diameters was found for the particles as a whole detected in the observed field.

The extent of Fe—Zn alloying of the plating layer was evaluated by randomly selecting 10 analysis points at each steel sheet and quantifying the concentration of Fe in the plating layer by glow discharge optical emission spectrometry. The size of each analysis point was made a constant diameter of 5 mm. When there are at least nine locations where the concentration of Fe in the plating layer is 7 to 15 wt %, a sheet is judged to pass, while in other cases, it is judged to fail. When there are two or more locations where the concentration of Fe in the plating layer is less than 7 wt %, it is judged that the alloying is insufficient and the sheet has failed, while when there are two or more locations where the concentration is over 15 wt %, it is judged that the alloying is excessive and the sheet has failed.

Table 3 shows the results of the evaluation. From Table 3, the test materials subjected to the alloying molten zinc plating which passed in strength, elongation, and alloying degree were all examples of the present invention. The comparative examples either passed in the strength and elongation, but failed in alloying degree or passed in elongation and alloying degree, but failed in strength. Further, it was confirmed that the plating layers in the test materials subjected to the alloying molten zinc plating of the examples of the present invention contained oxide particles of at least one type of oxides comprised of an Al oxide, Si oxide, Mn oxide, Al and Si complex oxide, Al and Mn complex oxide, Si and Mn complex oxide, or Al, Si, and Mn complete oxide.

TABLE 3

| Test material code | Treatment condition number | Average size of oxide particles in plating layer | Evaluation of strength | Evaluation of elongation | Evaluation of alloying degree | Remarks |
|---|---|---|---|---|---|---|
| NA | 3 | 0.2 | P | P | P | Invention ex. |
| NA | 4 | 0.4 | P | P | P | Invention ex. |
| NA | 5 | ND | P | P | F | Comp. ex. |
| NA | 7 | 0.4 | P | P | P | Invention ex. |
| NA | 8 | ND | P | P | F | Comp. Ex. |
| A | 3 | 0.4 | P | P | P | Invention ex. |

TABLE 3-continued

| Test material code | Treatment condition number | Average size of oxide particles in plating layer | Evaluation of strength | Evaluation of elongation | Evaluation of alloying degree | Remarks |
|---|---|---|---|---|---|---|
| A | 4 | 0.2 | P | P | P | Invention ex. |
| A | 5 | ND | P | P | F | Comp. Ex. |
| A | 7 | 0.2 | P | P | P | Invention ex. |
| A | 8 | ND | P | P | F | Comp. Ex. |
| B | 1 | 0.3 | P | P | P | Invention ex. |
| B | 2 | ND | P | P | F | Comp. Ex. |
| B | 3 | 0.2 | P | P | P | Invention ex. |
| B | 4 | 0.2 | P | P | P | Invention ex. |
| B | 5 | ND | P | P | F | Comp. Ex. |
| B | 6 | ND | P | P | F | Comp. Ex. |
| C | 1 | 0.5 | P | P | P | Invention ex. |
| C | 2 | ND | P | P | F | Comp. Ex. |
| C | 3 | 0.5 | P | P | P | Invention ex. |
| C | 4 | 0.5 | P | P | P | Invention ex. |
| C | 5 | ND | P | P | F | Comp. Ex. |
| C | 6 | ND | P | P | F | Comp. Ex. |
| C | 7 | 0.4 | P | P | P | Invention ex. |
| C | 8 | ND | P | P | F | Comp. Ex. |
| D | 3 | 0.6 | P | P | P | Invention ex. |
| D | 4 | 0.5 | P | P | P | Invention ex. |
| D | 5 | ND | P | P | F | Comp. Ex. |
| D | 6 | ND | P | P | F | Comp. Ex. |
| E | 3 | 0.2 | P | P | P | Invention ex. |
| E | 4 | 0.2 | P | P | P | Invention ex. |
| E | 5 | ND | P | P | F | Comp. Ex. |
| E | 6 | ND | P | P | F | Comp. Ex. |
| F | 3 | ND | P | F | P | Comp. Ex. |
| F | 4 | ND | P | F | P | Comp. Ex. |
| F | 5 | ND | P | F | P | Comp. Ex. |
| F | 6 | ND | P | F | P | Comp. Ex. |

P: pass,
F: fail,
ND: not detected.

INDUSTRIAL APPLICABILITY

The alloyed molten zinc plated steel sheet of the present invention is a steel sheet which contains oxide particles in the plating layer, whereby the area of the unformed parts of the Fe—Zn alloy phase becomes less than 10% of the area of the steel sheet as a whole and the strength and shapeability become superior. According to the process of production of the present invention, it is possible to produce this at a low cost by just changing the operating conditions of an existing continuous zinc plating production system.

The invention claimed is:

1. An alloyed molten zinc plated steel sheet characterized by comprising a steel sheet including, by wt %, C: 0.05 to 0.40%,
Si: 0.2 to 3.0%, and
Mn: 0.1 to 2.5% and
further including at least one of:
P: 0.001 to 0.05%,
S: 0.001 to 0.05%,
Al: 0.01% to 2%,
B: 0.0005% to less than 0.01%,
Ti: 0.01% to less than 0.1%,
V: 0.01% to less than 0.3%,
Cr: 0.01% to less than 1%,
Nb: 0.01% to less than 0.1%,
Ni: 0.01% to less than 2.0%,
Cu: 0.01% to less than 2.0%,
Co: 0.01% to less than 2.0%,
Mo: 0.01% to less than 2.0%, with the balance comprised of Fe and unavoidable impurities, having on its surface a Zn alloy plating layer comprised of Fe in a concentration of 7 to 15 wt %, Al in a concentration of 0.01 to 1 wt %, and the balance of Zn and unavoidable impurities, said plating layer containing oxide particles of at least one type of oxide selected from the group consisting of an Al oxide, Si oxide, Mn oxide, Al and Si complex oxide, Al and Mn complex oxide, Si and Mn complex oxide, and Al, Si, and Mn complex oxide alone or in combination, and an average diameter of the particle size of said oxide is 0.01-1 μm.

2. An alloyed molten zinc plated steel sheet as set forth in claim 1, characterized in that said oxide particles are comprised of at least one of silicon oxide, manganese oxide, aluminum oxide, aluminum silicate, manganese silicate, manganese aluminum oxide, and manganese aluminum silicate.

3. An alloyed molten zinc plated steel sheet as set forth in claim 1, characterized in that the structure of said steel sheet has a complex structure of a ferrite phase, bainite phase, and residual austenite phase.

4. A process of production of an alloyed molten zinc plated steel sheet described in claim 1 by a continuous molten zinc plating system, said process of production of an alloyed molten zinc plated steel sheet characterized by making a heating temperature T at a recrystallization annealing step in a reducing furnace of said system 650° C. to 900° C., passing the steel sheet through an atmosphere where a ratio $PH_2O/PH_2$ of the steam partial pressure $PH_2O$ and hydrogen partial pressure $PH_2$ of the atmosphere of said reducing furnace is:

$1.4\times10^{-10}T^2-1.0\times10^{-7}T+5.0\times10^{-4}$ to $6.4\times10^{-7}T^2+1.7\times10^{-4}T-0.1$, forming internal oxide at a region from the surface of the steel sheet to a depth of 1.0 μm, then successively performing molten zinc plating treatment and alloying treatment.

5. A process of production of an alloyed molten zinc plated steel sheet as set forth in claim 4, characterized in that said oxide particles are comprised of at least one of silicon oxide, manganese oxide, aluminum oxide, aluminum silicate, manganese silicate, manganese aluminum oxide, and manganese aluminum silicate.

6. A process of production of an alloyed molten zinc plated steel sheet as set forth claim 4, characterized in that the structure of said steel sheet has a complex structure of a ferrite phase, bainite phase, and residual austenite phase.

* * * * *